US008052433B2

(12) United States Patent
Yeh

(10) Patent No.: US 8,052,433 B2
(45) Date of Patent: Nov. 8, 2011

(54) ELECTRICAL CONNECTOR HAVING RETENTION MEANS ARRANGED ADJACENT TO PASSAGEWAY FOR HOLDING FUSIBLE MEMBER THERETO

(75) Inventor: Cheng-Chi Yeh, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/750,722

(22) Filed: Mar. 31, 2010

(65) Prior Publication Data

US 2010/0248504 A1 Sep. 30, 2010

(30) Foreign Application Priority Data

Mar. 31, 2009 (TW) ..... 98205047

(51) Int. Cl.
*H01R 12/00* (2006.01)

(52) U.S. Cl. ..... 439/83

(58) Field of Classification Search ..... 439/83, 439/876

See application file for complete search history.

(56) References Cited

U.S. PATENT DOCUMENTS 5,029,748 A 7/1991 Lauterbach
5,326,936 A * 7/1994 Taniuchi et al. ..... 174/260

* cited by examiner

*Primary Examiner* — Ross Gushi

(74) *Attorney, Agent, or Firm* — Andrew C. Cheng; Wei Te Chung; Ming Chieh Chang

(57) ABSTRACT

An electrical connector used for connecting a circuit processing unit (CPU) with pins with a print circuit board (PCB) includes an insulating housing, a plurality of terminals received in the housing and a plurality of fusible members mechanically fixed into the housing. The housing includes a plurality of passageways and receiving cavities communicating with each other. Each of the terminals received in the corresponding passageway has a soldering portion. Each fusible member mechanically fixed into the corresponding receiving cavity has a through hole for receiving the soldering portion of the terminal. A gap is formed between the soldering portion and the fusible member when the soldering portion received in the through hole.

17 Claims, 6 Drawing Sheets

2

ELECTRICAL CONNECTOR HAVING RETENTION MEANS ARRANGED ADJACENT TO PASSAGEWAY FOR HOLDING FUSIBLE MEMBER THERETO

BACKGROUND OF THE INVENTION

1. Field of the Invention

The present invention relates to an electrical connector, and more particularly to an electrical connector having retention means arranged adjacent to passageway for holding fusible members.

2. Description of Related Art

U.S. Pat. No. 5,029,748 issued to Lauterbach et al. on Jul. 9, 1991 disclosed an electrical connector for connecting a central processing unit (CPU) with a printed circuit board (PCB). The electrical connector includes an insulating housing having a plurality of terminals and a mass of solders received therein. In assembly, firstly place the terminals in the insulating housing, then melt and flow the solders to tail portions of the terminals, and finally place the electrical connector on the PCB and send them into a heating furnace, so as to reflow the solders to establish connection between the terminals and corresponding pads of the PCB.

However, the process of predeterminate soldering the solders to the terminals is complex and time-consuming which costs high.

In view of the above, an improved electrical connector for electrically connecting the CPU with the PCB is needed.

SUMMARY OF THE INVENTION

Accordingly, an object of the present invention is to provide an electrical connector having retention means arranged adjacent to passageway for holding fusible members, instead of predeterminately soldering fusible members thereto, so as to make process simple and cost down.

In order to achieve the above object, an electrical connector in accordance with a preferred embodiment of the present invention comprises an insulating housing, a plurality of terminals received in the insulating housing and a plurality of fusible members mechanically fixed into the insulating housing. The housing includes a plurality of passageways and receiving cavities defined by convex portions formed on a bottom face and are in communicating with each other. Each of the terminals received in the corresponding passageway has a soldering portion. Each fusible member mechanically held into the corresponding receiving cavity has a through hole for receiving the soldering portion of the terminal. The soldering portion of the terminal is apart from the fusible member when received in the through hole of the fusible member.

Other objects, advantages and novel features of the invention will become more apparent from the following detailed description when taken in conjunction with the accompanying drawings, in which:

DETAILED DESCRIPTION OF THE INVENTION

Reference will now be made to the drawings to describe the present invention in detail.

FIGS. 1-6 illustrate an electrical connector 100 in accordance to a preferred embodiment of the present invention, which is generally used for connecting a CPU (not shown) to a PCB (not shown). The electrical connector 100 comprises an insulating housing 1, a plurality of terminals 2 received in the insulating housing 1 and a plurality of fusible members 3 mechanically fixed to the housing 1.

Figure 3:
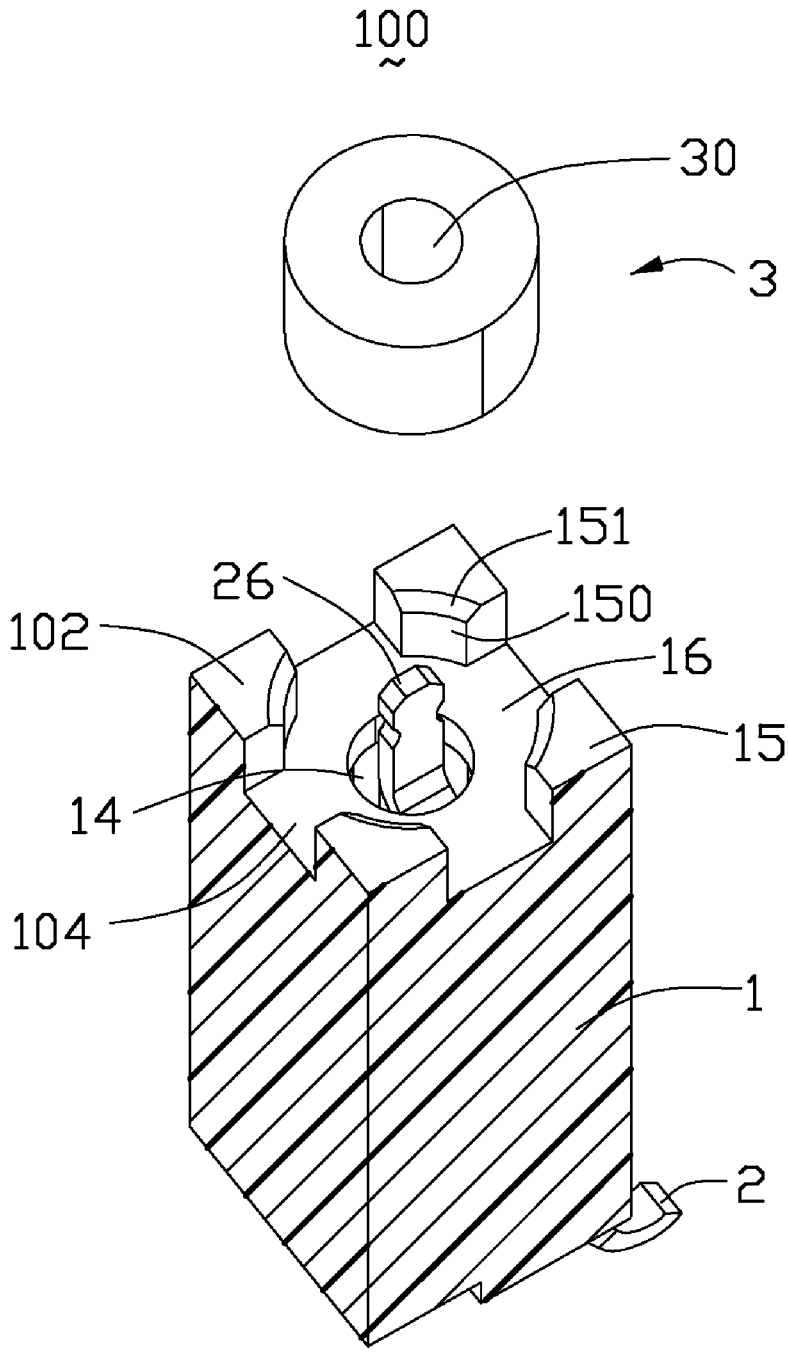
FIG. 3 is similar to FIG. 2, showing a fusible member detached from the electrical connector.
Figure 5:
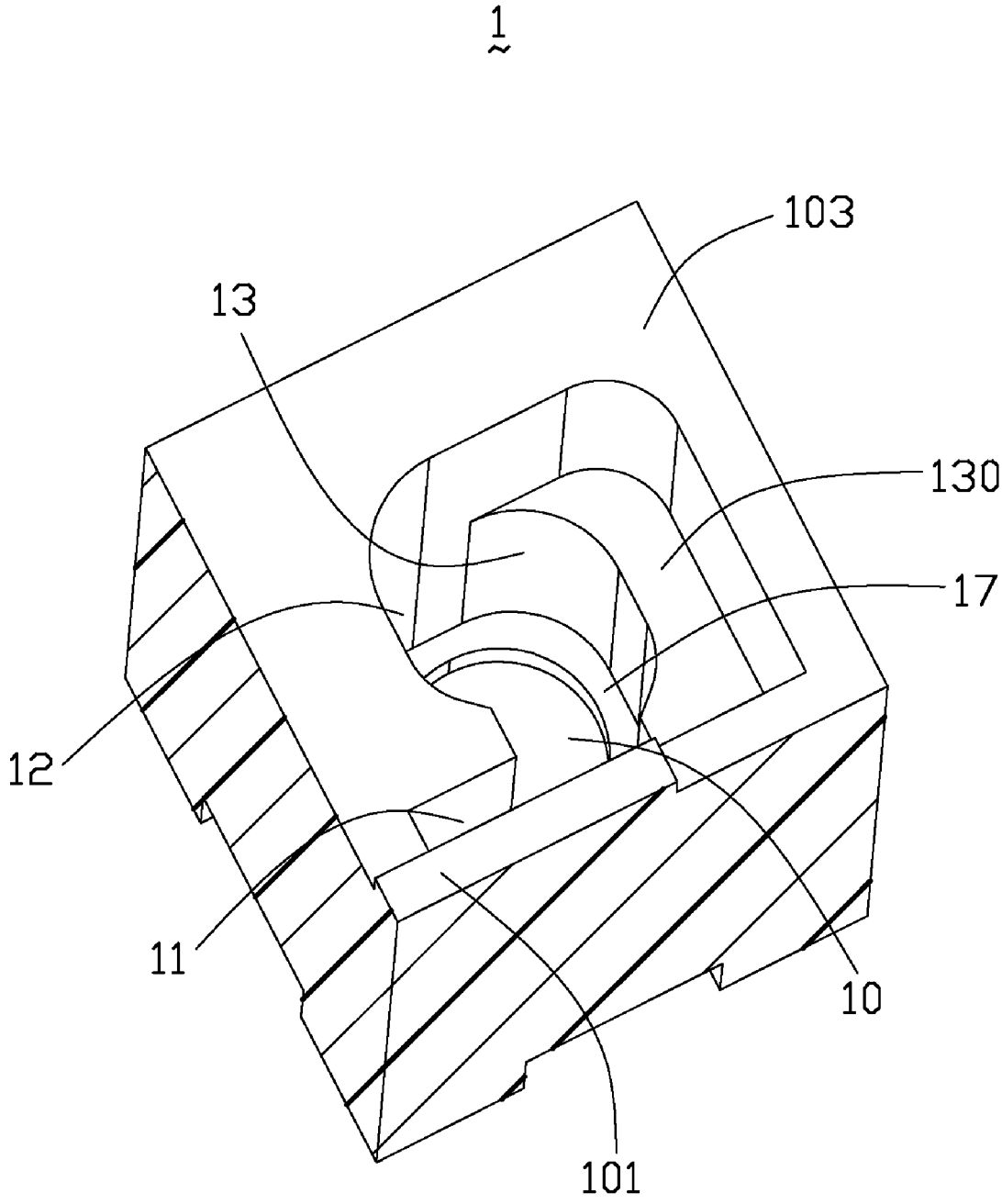
FIG. 5 is a partial, perspective view of the insulating housing shown in FIG. 2.

Referring to FIG. 3 and FIG. 5, the insulating housing 1 has a mating interface 101 and a mounting surface 102 opposite to each other. A plurality of passageways 10 extends between the mating interface 101 and the mounting surface 102. Each passageway 10 includes a retaining slot 11 and a receiving slot 12 communicating with each other. An arc-shaped blocking portion 13 is disposed in the receiving slot 12. A partition wall 17 is located below the receiving slot 12 and defines a hole 14 extending therethrough. The blocking portion 13 has an upper surface 130 located below the top face 103 of the insulating housing 1. A plurality of convex portions 15 are protruded downward from the bottom face 104 of the insulating housing 1 and define a receiving cavity 16 for receiving the fusible member 3. Each of the convex portions 15 includes a vertical surface 150 and a slant surface 151 at the inner side thereof. The vertical surface 150 can interferingly match with the fusible member 3 to hold the fusible member 3 in the receiving cavity 16 instead of predeterminately reflowing the fusible member 3 to the terminal 2, so as to make the process simple and reduce the cost. The slant surface 151 is located below the vertical surface 150 and expanded outwardly from the vertical surface 150 for guiding the fusible member to skip into the receiving cavity 16.

Figure 6:
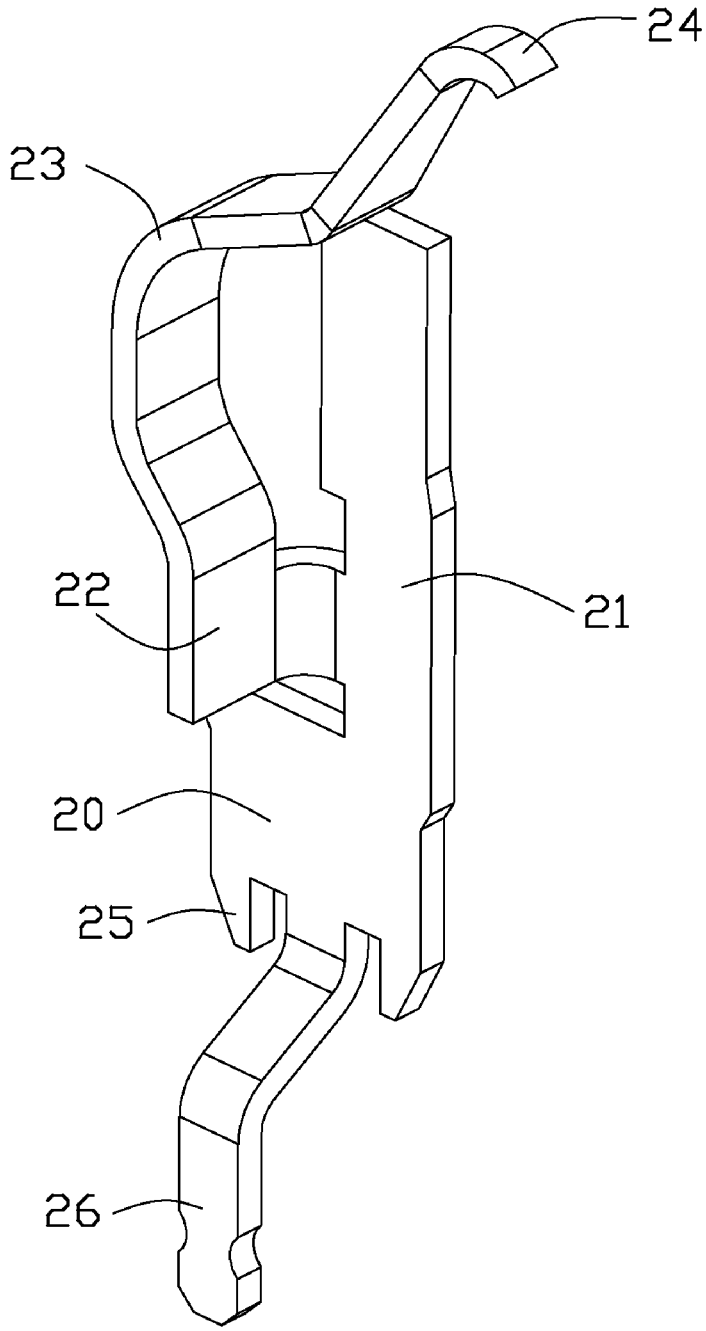
FIG. 6 is a perspective view of a terminal shown in FIG. 4.

Referring to FIG. 6, the terminal 2 stamped from a sheet of metallic material has a plate-like main portion 20, a holding portion 21 extending from the main portion 20. The main portion 20 and the holding portion 21 are both securely retained within the retaining slot 11. A bending portion 22 extends from the holding portion 21 and is perpendicular to the main portion 20. The bending portion 22 can abut against the blocking portion 13 to position the terminal 2 in the insulating housing 1. An elastic arm 23 extends upwardly from the bending portion 22 and includes an arc-shaped contacting portion 24 for electrical contacting with a conductive pad of the CPU (not shown). Two protrusions 25 extend downward from two sides of the main portion 20 for guiding the terminal 2 to assemble into the retaining slot 11. A soldering portion 26 bends downward from the main portion 20 and is located between the protrusions 25. The soldering portion 26 can pass through the hole 14 into the receiving cavity 16 of the insulating housing 1. The elastic arm 23, the bending portion 22 and the soldering portion 26 are located at the same side of the main portion 20.

Figure 1:
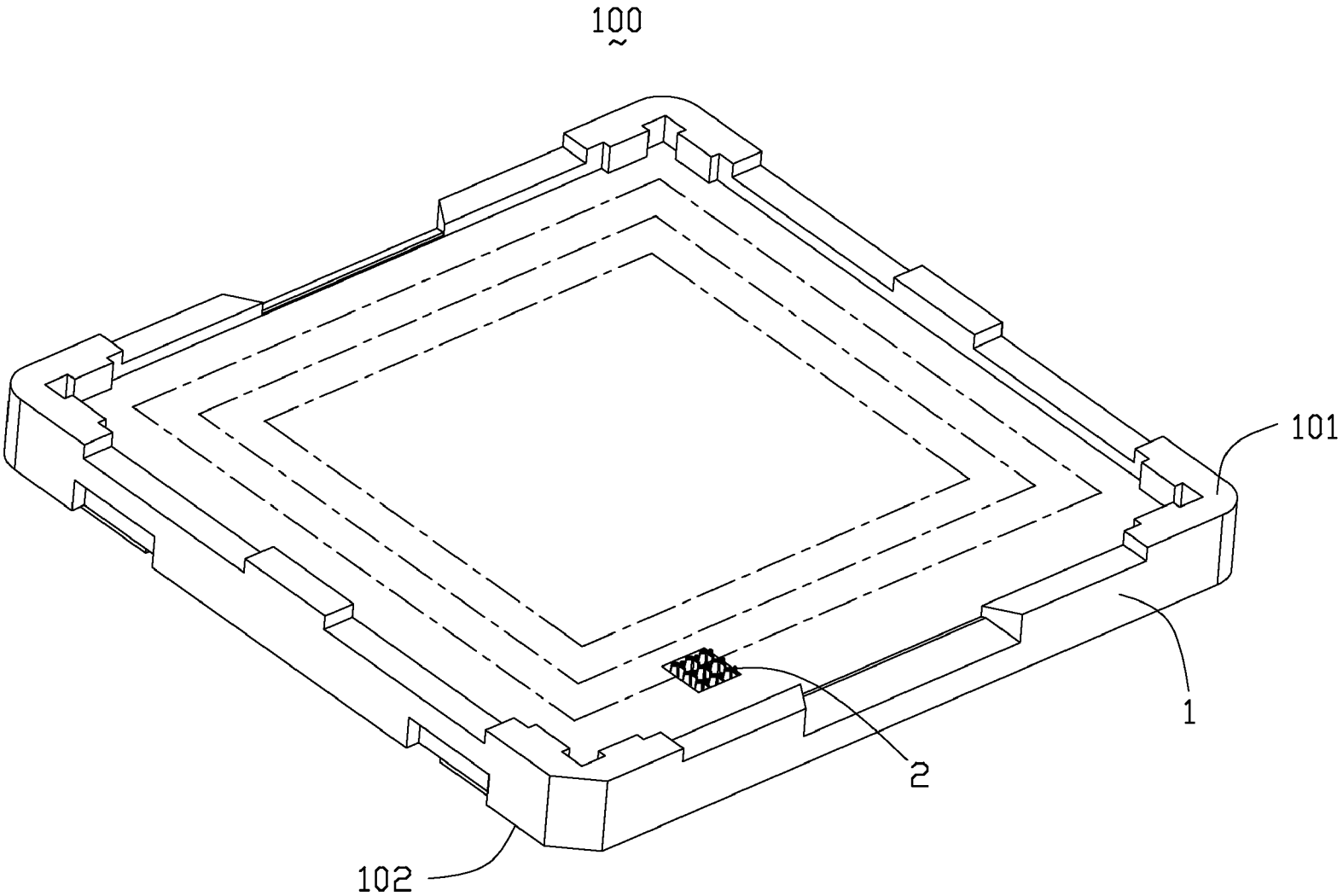
FIG. 1 is an assembled, perspective view of an electrical connector in accordance with a preferred embodiment of the present invention.
Figure 2:
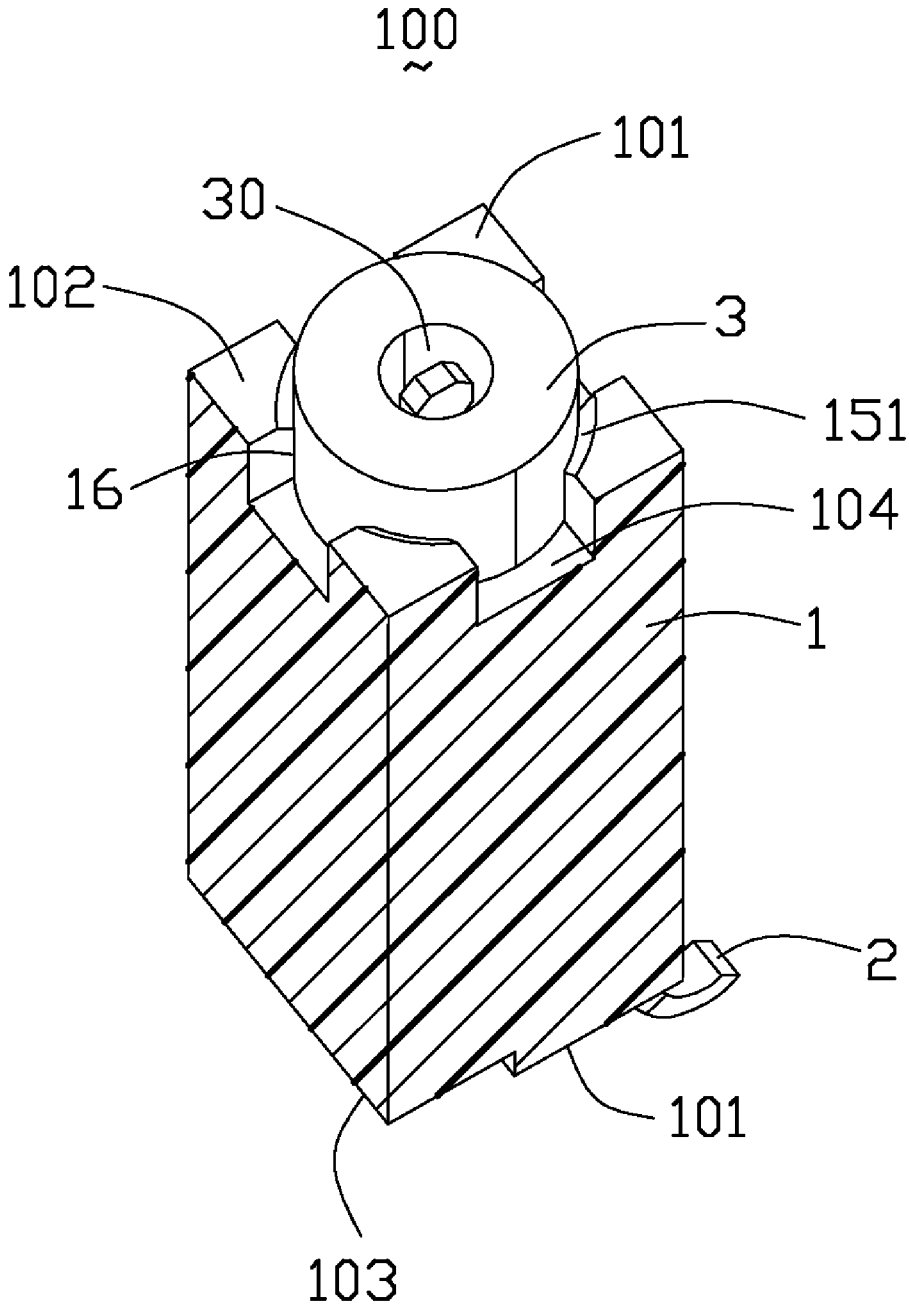
FIG. 2 is a partial, perspective view of the electrical connector shown in FIG. 1.
Figure 4:
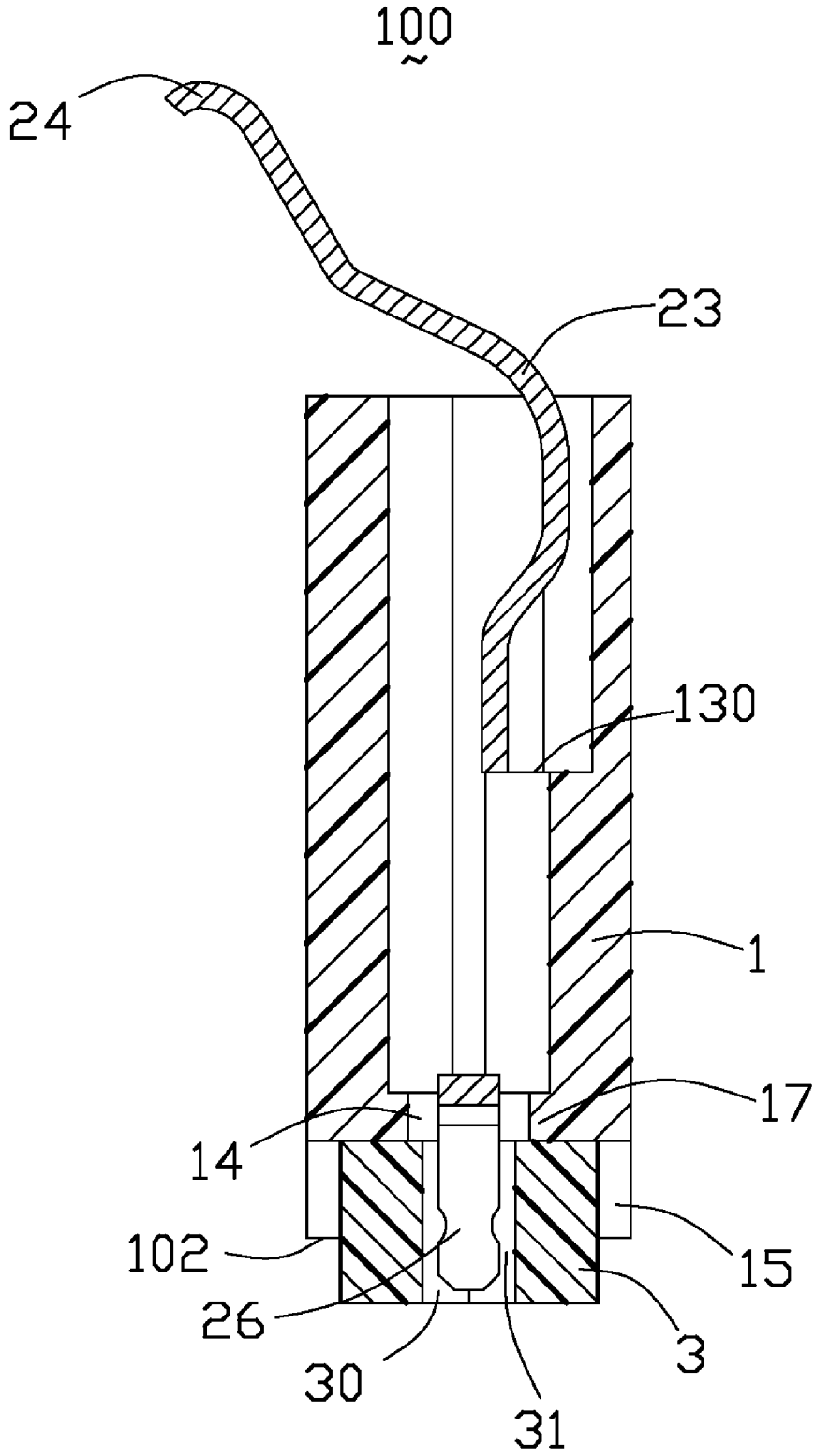
FIG. 4 is a partial, cross-sectional view of the electrical connector shown in FIG. 1.

Referring to FIG. 2 to FIG. 4, the fusible member 3 has a cylindrical structure and includes a through hole 30 at a center thereof. The through hole 30 is used for receiving the soldering portion 26 of the terminal 2 and has a dimension larger than that of the soldering portion 26. A gap 31 is formed between the soldering portion 26 and the through hole 30 after the soldering portion 26 is received in the fusible member 3.

The dimension of the through hole 30 is smaller than that of the hole 14, so that the fusible member 3 can flow toward the hole 14 to prevent short circuits caused by the adjacent fusible members 3 overflowing to contact with each other when heating and melting the fusible member 3 to solder the soldering portion 26 of the terminal 2 with the PCB (not shown). The fusible member 3 can fully surround the soldering portion 26 after melting.

In assembly, the terminal 2 is received in the passageway 10 and the fusible member 3 is mechanically held into the corresponding receiving cavity 16. The elastic arm 23 is partially disposed within the receiving slot 12. The soldering portion 26 is received in the through hole 30 of the fusible member 3 but not contacted with the fusible member 3.

While the preferred embodiments in accordance with the present invention has been shown and described, equivalent modifications and changes known to persons skilled in the art according to the spirit of the present invention are considered within the scope of the present invention as defined in the appended claims.

What is claimed is:

1. An electrical connector for connecting a CPU (central processing unit) with a PCB (printed circuit board) comprising:

an insulating housing having a plurality of passageways and receiving cavities communicating with each other;

a plurality of terminals received in the corresponding passageways and each having a soldering portion; and a plurality of fusible members mechanically held into the corresponding receiving cavities and each having a through hole; wherein the soldering portion of the terminal is received in the through hole and apart from the fusible member, and wherein a plurality of convex portions extends downward from a bottom surface of the insulating housing, and the receiving cavity is defined by the convex portions.

2. The electrical connector as claimed in claim 1, wherein each of the convex portions includes a vertical surface and a slant surface at inner side thereof, and wherein the vertical surface can interferingly match with the fusible member to hold the fusible member to the receiving cavity, and wherein the slant surface can guide the fusible member to skip into the receiving cavity.

3. The electrical connector as claimed in claim 1, wherein the through hole has a dimension larger than that of the soldering portion.

4. The electrical connector as claimed in claim 1, wherein each passageway includes a receiving slot and a retaining slot communicating with each other, and wherein a partition wall is located below the receiving slot with a hole extending therethrough.

5. The electrical connector as claimed in claim 4, wherein each of the terminals further includes a main portion and a holding portion extending from the main portion, and wherein the main portion and a holding portion are both received in the retaining slot.

6. The electrical connector as claimed in claim 5, wherein a blocking portion is disposed in the receiving slot, and wherein the terminal defines a bending portion bending from the holding portion, and wherein the bending portion abuts against the blocking portion.

7. An electrical connector comprising:

an insulating housing defining a top face and a bottom face opposite to each other;

a plurality of passageways extending between the top face and the bottom face;

an encampment associated with each of the passageways at the bottom face, and including an extension crossing over a partition wall of the passageway to substantially enlarge the passageway;

a plurality of terminals each having an elastic arm extending beyond the top face, a main portion disposed in the passageway, and a soldering portion extending beyond the bottom face;

a plurality of fusible members each mechanically disposed in the encampment and secured by the extension of the encampment; and wherein a gap is formed between the soldering portion of the terminal and the fusible member.

8. The electrical connector as claimed in claim 7, wherein a plurality of convex portions extend downward from the bottom face of the insulating housing, and wherein the encampment is defined by the convex portions.

9. The electrical connector as claimed in claim 8, wherein each of the passageways includes a receiving slot and a retaining slot communicating with each other.

10. The electrical connector as claimed in claim 9, wherein each of the terminals includes a holding portion extending from the main portion, and wherein the main portion and the holding portion are both securely retained in the retaining slot.

11. The electrical connector as claimed in claim 10, wherein a blocking portion is disposed in the receiving slot, and wherein the terminal further includes a bending portion abutting against the blocking portion.

12. The electrical connector as claimed in claim 11, wherein the elastic arm, the bending portion and the soldering portion are located at the same side of the main portion.

13. The electrical connector as claimed in claim 7, wherein the fusible member has a cylindrical structure.

14. An electrical connector comprising:

an insulative housing defining opposite upper and lower surfaces with a plurality of passageways therethrough in a vertical direction;

a plurality of contacts disclosed in the corresponding passageways, respectively, each of said contacts defining an upper contacting section located around the upper surface, and a lower soldering section exposed around the lower surface;

a plurality of solder gripping devices unitarily formed on the lower surface corresponding to said soldering sections, respectively, and a plurality of solder masses located around the corresponding soldering sections and gripped by the corresponding solder gripping devices for retention, respectively, wherein the soldering section provides no substantial retention to the corresponding solder mass before said solder mass is fused upon a printed circuit board.

15. The electrical connector as claimed in claim 14, wherein the solder mass essentially surrounds the corresponding soldering section before being fused upon the printed circuit board.

16. The electrical connector as claimed in claim 14, wherein said soldering section defines at least one notch to receive the fused solder mass for enhancing retention between the soldering section and the solder mass.

17. The electrical connector as claimed in claim 14, wherein said solder mass is lower than a bottom tip of the corresponding soldering section before being fused to the printed circuit board.

* * * * *